US006827010B2

(12) United States Patent
Heikkinen et al.

(10) Patent No.: US 6,827,010 B2
(45) Date of Patent: Dec. 7, 2004

(54) MULTI-ROLL CALENDER

(75) Inventors: Antti Heikkinen, Helsinki (FI); Pekka Linnonmaa, Gladstone, MI (US)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/694,291

(22) Filed: Oct. 27, 2003

(65) Prior Publication Data

US 2004/0083910 A1 May 6, 2004

Related U.S. Application Data

(63) Continuation of application No. 10/089,427, filed as application No. PCT/FI00/00821 on Sep. 26, 2000, now Pat. No. 6,698,342.

(30) Foreign Application Priority Data

Sep. 29, 1999 (FI) ..... 19992086

(51) Int. Cl.[7] ..... B30B 11/22
(52) U.S. Cl. ..... 100/331; 100/161; 100/176
(58) Field of Search ..... 100/331, 74, 161, 100/176, 305, 92, 155 R, 327, 41, 203, 204, 207, 38; 162/205, 206

(56) References Cited

U.S. PATENT DOCUMENTS 2,291,616 A * 8/1942 Fletcher ..... 427/326
3,270,664 A * 9/1966 Veneman et al. ..... 100/162 R
4,370,923 A 2/1983 Schmidt
4,935,097 A 6/1990 Tashiro et al.
5,163,365 A * 11/1992 Taylor ..... 100/38
5,524,532 A 6/1996 Koivukunnas et al.
5,557,860 A 9/1996 Kotitschke et al.
5,607,553 A 3/1997 Chadha
5,669,295 A 9/1997 Kayser et al.
5,914,008 A 6/1999 Winheim
6,073,549 A 6/2000 Winheim et al.
6,274,001 B1 8/2001 Mohan

FOREIGN PATENT DOCUMENTS

EP 0 719 891 A2 7/1996
WO WO 01/23666 A3 4/2001

OTHER PUBLICATIONS

International Preliminary Examination Report issued in International Patent Application No. PCT/FI00/00821.
International Search Report issued in International Patent Application No. PCT/FI00/00821.
National Board of Patents and Registration Search Report issued in Finnish Application No. 19992086.

* cited by examiner

*Primary Examiner*—Allen Ostrager
*Assistant Examiner*—Shelley Self
(74) *Attorney, Agent, or Firm*—Stiennon & Stiennon

(57) ABSTRACT

A multi-roll calender for controlling the moisture gradient of a fibrous web and for enabling the manufacture of high quality paper grades, such as WFC, LWC-roto and SC-A by on- and off-line calendering. An on- or off-line multi-roll calender formed of separate sets of rolls is used for calendering, and the fibrous web (W) is subjected to intermediate moistening between the sets of rolls (A, B).

8 Claims, 1 Drawing Sheet

MULTI-ROLL CALENDER

CROSS REFERENCES TO RELATED APPLICATIONS

This application is a continuation of U.S. application Ser. No. 10/089,427, filed on Jun. 26, 2002 now U.S. Pat. No. 6,698,342, which was a U.S. national stage application of International Application No. PCT/FI00/00821, filed Sep. 26, 2000, and claims priority on Finnish Application No 19992086 filed Sep. 29, 1999.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to the calendering of a fibrous web.

Calendering is a method by means of which the properties, in particular the thickness profile, smoothness, gloss, surface porosity and translucence of a web-like material, such as a paper web, are sought to be generally improved. In calendering the paper web is passed into a nip which is formed between rolls pressed against each other and in which the paper web is deformed by the action of temperature, moisture and nip pressure, in which connection the physical properties of the paper web can be affected by controlling the above-mentioned parameters and the time of action. The good physical properties attained by calendering lead to better print quality, thereby bringing a competitive advantage to the manufacturer of paper.

The so-called shoe rolls known in prior art are usually hydraulically deflection-compensated, zone-controlled rolls in which the shell is supported from a non-rotating central shaft of the roll by means of hydrostatic loading arrangements, such as rows of loading shoes, which transfer the nip force acting on the shell rotating around the central shaft so as to be carried by the central shaft. The loading element is generally also divided into zones, in which connection the loading pressure can be regulated as required by profiling. The zoning in this kind of zone-controlled shoe roll may comprise individual elements in the loading arrangement, in which connection the number of zones in the roll and in the loading arrangement may exceed 60—as examples may be mentioned the shoe rolls marketed by Metso Paper, Inc. under the trademarks SymCD™ and SymCDS™, or the zoning may comprise a group of elements in the loading arrangement, in which connection the roll and the loading arrangement normally comprise eight zones—as examples may be mentioned the shoe rolls marketed by Metso Paper, Inc. under the trademarks SymZ™, SymZS™, SymZL™, and SymZLC™. Extended-nip calendering accomplished by means of a shoe roll has generally been found to be good for producing low-gloss paper grades, i.e. grades having a Hunter gloss % below 40. When higher gloss is required, the nip pressure of extended-nip calendering is, however, not any more sufficient to provide gloss.

In the papermaking art, grades of ever higher quality are required today. As the running speeds required of paper machines are continuously increasing, the direction in calendering technology is more and more towards on-line solutions. When the aim is to make higher quality printing paper grades, such as, for example, SC-A and LWC-roto grades and glossy coated paper grades, a substantial problem is that this kind of grades can be produced in practice only by using, after drying a fibrous web, intermediate winding and off-line supercalenders, several of said supercalenders, usually two or three, being used side by side to meet production capacity.

Supercalendering is calendering in a calender unit in which nips are formed between a smooth-surface press roll, such as a metal roll, and a roll covered with a resilient coating, such as a paper or polymer roll. The resilient-surface roll adapts itself to the contours of the surface of paper and presses the opposite side of paper evenly against the smooth-surface press roll. Today, the supercalender typically comprises 10–12 nips and for the purpose of treating the sides of the web, the supercalender comprises a so-called reversing nip in which there are two resilient-surface rolls against each other. Linear load increases in the supercalender from the top nip to the bottom nip because of the force of gravity. This increase in load can be compensated for by using the relieving of the rolls. Supercalendering is an off- and on-line calendering method, and at the moment it provides the best paper qualities, such as, for example, WFC, LWC-roto and SC-A.

Soft calendering is calendering in a calender unit in which nips are formed between a smooth-surface press roll, such as a metal roll, and a roll covered with a resilient coating, such as a paper or polymer roll. In a soft calender, the nips are formed between separate roll pairs. In order to treat both sides of the web in the soft calender, the order of the roll pairs forming the successive nips is inverted with respect to the web so that the resilient-surface roll may be caused to work on both surfaces of the web. Soft calendering is an on- or off-line calendering method, and grades, such as, for example, MFC and film coated LWC as well as SC-C can be produced by means of it.

Multi-roll on-line, off-line calendering is calendering in a calender unit in which the number of rolls is higher than in soft calenders, most commonly 6–16. Multi-roll calenders are soft-nip calenders. The resilient-surface roll conforms to the contours of the surface of paper and presses the opposite side of paper evenly against the smooth-surface press roll. Linear load increases in the multi-roll calender from the top nip to the bottom nip because of the force of gravity. By using the relieving of rolls, this increase in load can be compensated for. This kind of relieving of the rolls is provided in Metso Paper, Inc.'s OptiLoad™ calender. Multi-roll on-line, off-line calendering is a calendering method, allowing grades from WFS up to uncoated fine paper to be produced.

SUMMARY OF THE INVENTION

The primary object of the present invention is

- to improve calendering of a fibrous web in connection with a papermaking process,
- to improve control of the moisture gradient of a fibrous web, such as a paper or board web,
- to diminish the process problems now associated with the manufacture of high quality paper grades, such as WFC, LWC-roto and SC-A, and
- to enable the manufacture of high quality paper grades, such as WFC, LWC-roto and SC-A by on- or off-line calendering.

Thus, the invention is based on the new and inventive idea that an on- or off-line multi-roll calender comprising separate sets of rolls is used for calendering, and that the fibrous web is subjected to intermediate moistening between the sets of rolls. In accordance with an advantageous embodiment of the invention, the multi-roll calender comprises two sets of rolls, in which connection the moisture content of the fibrous web coming from the drying process is raised to a level of 3–10% by means of pre-moistening preceding the first set of rolls, the fibrous web is dried to a level of 1–6% in the first set of rolls, the moisture content of the fibrous web is raised to a level of 6–14% by means of intermediate moistening after the first set of rolls, and the fibrous web is dried in the second set of rolls to a desired final moisture level, which is advantageously in a range of 4.5–7.5%.

With respect to the benefits of the invention, it may be mentioned that by means of the multi-stage moistening and gradient calendering according to the invention it is possible to better and more accurately affect only the surface layers of the fibrous web and to leave the inner layers of the fibrous web substantially untouched, which allows higher quality paper grades to be produced by on- or off-line calendering.

BRIEF DESCRIPTION OF THE DRAWINGS

In the following, the invention will be described in more detail by means of one of its embodiments considered advantageous with reference to the accompanying patent drawing whose figure FIG. 1 schematically shows a multi-roll calender according to an embodiment of the invention regarded as advantageous.

DESCRIPTION OF THE PREFERRED EMBODIMENTS

Figure 1:
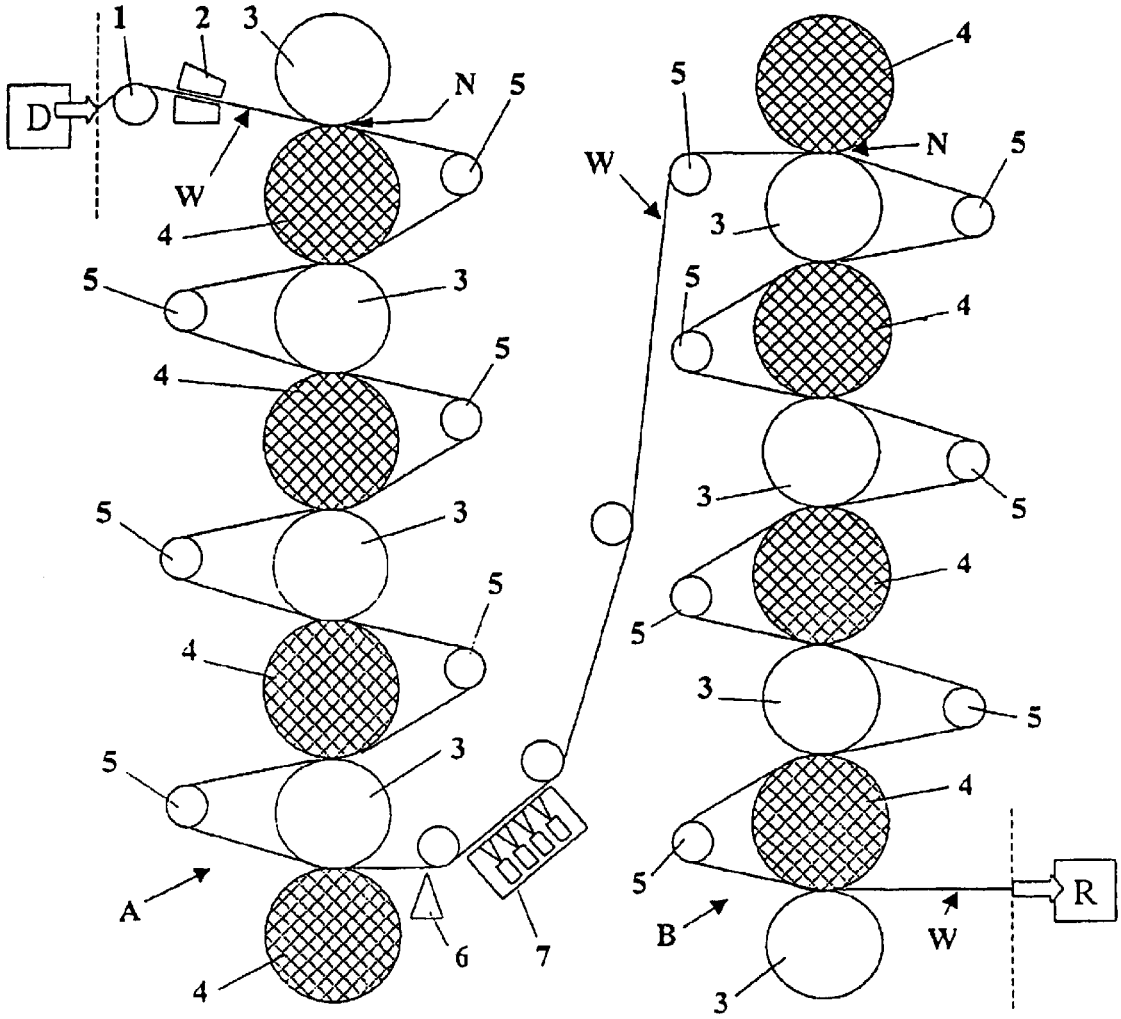

The calender in the embodiment shown in FIG. 1 is a multi-roll calender comprising two sets of rolls A and B in accordance with the invention.

Both sets of rolls A and B of the multi-roll calender are formed of smooth-surface press rolls 3, such as metal rolls, rolls 4 covered with a resilient coating, such as paper or polymer rolls, and reversing or guide members 5 guiding the run of a web W to be calendered, placed alternately one after the other in the machine direction. The successive nips N of the multi-roll calender are thus always formed between a roll 3 having a rigid shell and a roll 4 having a resilient shell.

Since the multi-roll calender is an on- or off-line calender, the fibrous web W which is calendered is passed from a drying process D without any intermediate winding directly to the calendering process. In the calendering process accomplished by means of the multi-roll calender with two sets of rolls in accordance with the invention, the run of the fibrous web W to be calendered is as follows. The fibrous web W is passed by means of a guide roll 1 through pre-moistening into the topmost nip N of the first set of rolls A in the multi-roll calender, from which nip the fibrous web W is passed around a reversing member 5, for example a reversing roll, into the next lower nip. After that, the fibrous web W meanders around a reversing member 5 and runs through the nips situated one underneath the other until the fibrous web W has been passed through the bottom nip in the first set of rolls A. After that, the fibrous web W is passed into the topmost nip N of the second set of rolls B, from which the fibrous web W is passed again around a reversing member 5 into the following lower nip. The fibrous web W meanders again around a reversing member 5 and runs through the nips N situated one underneath the other until the fibrous web W has been passed through the bottom nip N in the second set of rolls B. After the bottom nip of the second set of rolls B, the fibrous web W is passed to a process stage after calendering, which is, for example, reeling R.

In accordance with the invention, this run of the fibrous web is affected such that the fibrous web to be calendered is dried in the drying process D so that it is overdried, i.e. to a moisture content that is lower than the equilibrium moisture content dependent on the ambient operating conditions, and the moisture content of the fibrous web W passed from the drying process D to the calendering is raised by means of a pre-moistening unit 2 preceding the first set of rolls A, the fibrous web W is dried in the first set of rolls A, the moisture content of the fibrous web W is raised after the first set of rolls A by means of an intermediate moistening unit 7, and the fibrous web W is dried to a desired final moisture level in the second set of rolls B.

In that connection, in accordance with the invention it is advantageous that the first drying with the pre-drying unit 2 raises the moisture content of the fibrous web W, which is advantageously overdried according to the invention, to a level of 3–10%, in which connection the first set of rolls A can dry the fibrous web W to a level of 1–6%, and that the second moistening with the intermediate moistening unit 7 raises the moisture content of the fibrous web W to a level of 6–14%, in which connection the second set of rolls B can dry the fibrous web W to a desired final moisture level, which is advantageously in a range of 4.5–7.5%. This kind of multi-stage moistening allows the moistening to be applied substantially only to the surface layers of the fibrous web and enables the moisture gradient of the fibrous web to be controlled with fewer problems and more quickly than before, thereby allowing provision of higher quality paper grades, such as, for example, WFC, LWC-roto and SC-A.

To control the amount of the intermediate moistening of the fibrous web W and/or the penetration of moisture into the fibrous web and to thereby control the moisture gradient, the intermediate moistening unit 7, which is either a water moistener or an electricity-aided moistener, can be arranged optionally either to moisten the fibrous web W on one side or to moisten the fibrous web on both sides.

In order to minimize the formation of drop marks, the surface energy of the fibrous web W is lowered prior to the intermediate moistening unit 7 by manipulating the surface energy of the fibrous web, whereby the spreading of water on the surface of the fibrous web is accelerated because of the reduced surface energy of the fibrous web.

In one embodiment of the invention regarded as advantageous, a unit 6 for reduction and/or manipulation of the surface energy of the fibrous web W comprises a unit for corona treatment of the fibrous web, which unit is linked with the intermediate moistening unit 7 composed of a water moistener.

Above, the invention has been described only by way of example by means of one of its embodiments regarded as advantageous. This is naturally not intended to limit the invention and, as is clear to a person skilled in the art, a variety of alternative arrangements and modifications are feasible within the inventive idea and within the scope of protection thereof defined in the accompanying claims.

What is claimed is:

1. A multi-roll calender and a fibrous web traversing said multi-roll calender, which multi-roll calender is an on- or off-line multi-roll calender comprising separate first and second sets of rolls, each set of rolls comprising rigid-shell press rolls and resilient-shell backing rolls for the press rolls, placed alternately one after the other, successive nips being situated between the press rolls and the backing rolls placed against each other, as well as a reversing or guide member guiding the run of the fibrous web so that as the fibrous web extends from each press roll to each reversing or guide member, the web leaves a surface defined by either a press roll or a backing roll while traveling between successive nips, wherein in the on- or off-line multi-roll calender comprising two sets of rolls the fibrous web extends past an intermediate moistening means after a first set of rolls, and before the second set of rolls, and that in the calender:

a pre-moistening means immediately precedes the first set of rolls, and wherein the fibrous web enters the first set of rolls having a moisture content which is higher than the fibrous web moisture content immediately before the pre-moistening means;

the fibrous web has a moisture content which is lower immediately after the first set of rolls;

after the first set of rolls and the intermediate moistening means, the fibrous web has a moisture content which is higher than the moisture content of the fibrous web immediately before the intermediate moistening means; and the fibrous web after the second set of rolls has a moisture level lower than the moisture level of the fibrous web before the second set of rolls.

2. The multi-roll calender of claim 1, wherein the fibrous web after the pre-moistening means has a moisture level of 3–10%, and the fibrous web after the first set of rolls has a moisture level of 1–6%, and after the intermediate moistening means the fibrous web has a moisture level of 6–14%, and after the second set of rolls the fibrous web has a moisture level of 4.5–7.5%.

3. The multi-roll calender of claim 2 further comprising a means for overdrying the fibrous web before the pre-moistening unit preceding the first set of rolls, such that the moisture content of the fibrous web is lower than the equilibrium moisture content dependent on the ambient conditions.

4. The multi-roll calender of claim 1 wherein the web has a first side and a second side, and surface layers, and wherein the intermediate moistening means is positioned opposite the first side of the fibrous web to produce a higher moisture content in the surface layers of the first side of the fibrous web.

5. A calender apparatus for control of the moisture gradient of a paper or board web, comprising:

means for pre-moistening the web for raising the moisture content of the web passing from a drying process;

a first set of rolls of a first multi-roll calender immediately following the means for pre-moistening the web, the first set of rolls comprising a plurality of rigid-shell press rolls and resilient-shell backing rolls for the press rolls, placed alternately one after the other, successive nips being formed between one of said rigid-shell press rolls and one of said resilient-shell backing rolls situated against each other, a reversing or guide member preceding each successive nip guiding the run of the fibrous web, the first set of rolls acting to dry the web passing therethrough;

an intermediate moistening unit positioned to receive the web from the first set of rolls, and to raise the moisture content of the web; and a second set of rolls of a second multi-roll calender comprising a plurality of rigid-shell press rolls and resilient-shell backing rolls for the press rolls, placed alternately one after the other, successive nips being formed between one of said rigid-shell press rolls and one of said resilient-shell backing rolls being situated against each other, as well as a reversing or guide member preceding each successive nip guiding the run of the fibrous web, the second set of rolls acting to dry the web passing therethrough to a desired final moisture level, the second set of rolls following the intermediate moistening unit.

6. The multi-roll calender of claim 5 wherein the rolls of the first set of rolls of the first multi-roll calender have means for relieving roll loads and the rolls of the second set of rolls of the second multi-roll calender have means for relieving roll loads.

7. The multi-roll calender of claim 1 wherein the rolls of the first set of rolls have means for relieving roll loads and the rolls of the second set of rolls have means for relieving roll loads.

8. The multi-roll calender of claim 5 wherein the web has a first side and a second side, and wherein the intermediate moistening unit is positioned opposite the first side of the fibrous web to produce a higher moisture in the surface layers of the first side of the fibrous web.

* * * * *